United States Patent [19]

Battarel

[11] 4,130,859

[45] Dec. 19, 1978

[54] POCKET LAMP

[75] Inventor: Alain Battarel, St. Aubin les Elbeuf, France

[73] Assignee: Compagnie Industrielle des Piles Electriques "Cipel" S.A., Levallois-Perret, France

[21] Appl. No.: 744,302

[22] Filed: Nov. 23, 1976

[30] Foreign Application Priority Data

Nov. 28, 1975 [FR] France ..... 75 36561

[51] Int. Cl.[2] ..... F21L 7/00

[52] U.S. Cl. ..... 362/205; 362/189

[58] Field of Search ..... 240/10.66, 10.65, 10.6 R; 362/189, 205, 190, 194, 195, 198, 200, 202, 204; 200/60

[56] References Cited

U.S. PATENT DOCUMENTS

| | | | |
|---|---|---|---|
| 1,676,849 | 7/1928 | Barany | 240/10.66 |
| 3,443,084 | 5/1969 | Jammet | 240/10.65 |

*Primary Examiner*—Samuel W. Engle
*Assistant Examiner*—Ralph Palo
*Attorney, Agent, or Firm*—Kenyon & Kenyon, Reilly, Carr & Chapin

[57] ABSTRACT

The invention relates to a pocket lamp having an electric battery, a light bulb, a housing one of whose walls is made of a plastic material and supports the light bulb and forms a reflector and conductors forming with the light bulb and the battery an electric circuit closed by a switch. The switch has a knob sliding along the wall of the housing and which can be placed in two stable positions which are determined by a resilient appendage belonging to the aforementioned wall and co-operating with a protuberance formed in the knob. Application to pocket torches having a flat electric battery.

9 Claims, 6 Drawing Figures

POCKET LAMP

The present invention relates to a pocket lamp, and it is particularly, but not exclusively, applicable to disposable lamps which are thrown away once the battery is worn out.

Pocket lamps are also commonly referred to as torches or as flashlights, no limitation is implied concerning the size of the "pocket".

Preferred embodiments of the present invention provide simple reliable means for turning the lamp on and off by means of a slider.

The present invention provides a pocket lamp comprising: an electric battery; a housing enclosing the battery and having at least one wall made of plastics material, the said one wall supporting a light bulb and providing a reflector around the light bulb; a first conductor providing an electrical connection between one pole of the battery and one terminal of the light bulb; a second conductor in the form of a resilient blade permanently connected to the other pole of the battery; and a slider means serving as a switch mounted on a wall of the container and cooperating with the resilient blade to move it into and out of contact with the other terminal of the light bulb, wherein the plastic wall forming the reflector has a resilient appendage projecting into the housing and cooperating with the slider means to determine two stable positions for the slider means corresponding respectively to the opening and to the closing of the lamp circuit.

The resilient appendage which ensures the on/off switching action of the slider means is an integral part of the said one plastic wall and therefore requires no extra parts or assembly operation during manufacture of the lamp. An embodiment of the invention, together with variations of the appendage, is described by way of example having no limiting character, with reference to the accompanying drawings in which.

Figure 1:
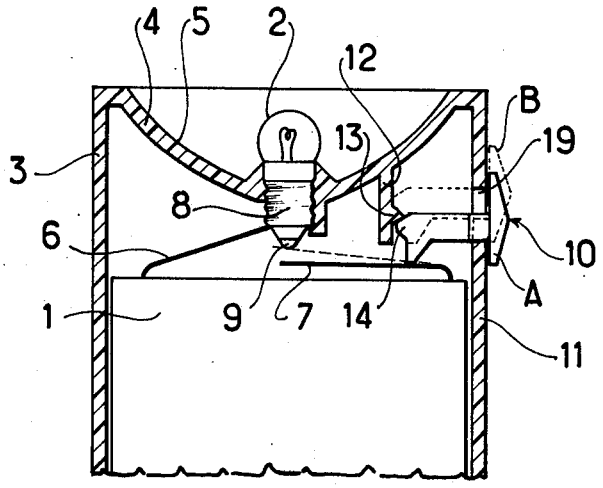
FIG. 1 is a partial cross-section of a pocket lamp embodying the invention.

The lamp shown in FIG. 1 comprises a battery 1 formed by one, or two or three cylindrical electric cells arranged side by side in a flat pack, and if of more than one cell, connected together in series, a light bulb 2, a housing 3 made of plastic material whose top wall 4 supports the light bulb 2 and includes a reflector 5 (facing upwards in the drawing) and two conductive blades 6 and 7 which together with the battery 1 and the light bulb 2 form an electric circuit. The conductive blade 6 permanently connects one side of the base 8 of the light bulb to a pole of the battery. The conductive blade 7 is resilient and connected permanently to the other pole of the battery. It can be moved into and out of contact with the contact stud 9 at the end of the light bulb, closing or opening the electric circuit from the battery to the lamp. The movement of the resilient blade 7 is controlled by slider means 10 slidable along the wall 11 of the housing.

Figure 2:
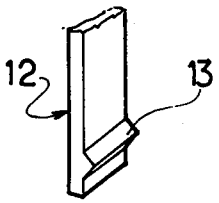
FIG. 2 is a perspective view of an appendage of the torch of FIG. 1.

The wall 4 has a resilient appendage 12 in the form of a tongue of which a perspective view is shown in FIG. 2, which is in contact with portions of the slider means 10. On the surface of the tongue 12 which faces the said slider means a transverse rib 13 is provided which has a triangular cross-section cooperating with one or two internally extending protuberances 14 of the slider means 10 to determine two stable positions of the latter: when the protuberances 14 are below the ridge of the rib 13 , the contact blade 7 is kept pressed down away from bulb stud 9 and the circuit is open, and when the protuberances are above the ridge, the blade 7 rises elastically and the electric circuit is closed, causing the lamp to light. During movement of the slider means 10 from one position to the other the tongue 12 bends elastically to allow the protuberances 14 to pass from one side to the other of the ridges of rib 13.

Figure 3:
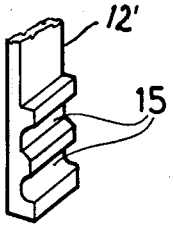
FIGS. 3 and 4 are similar views to FIG. 2, relating to variations in the appendage.

In the embodiment of FIG. 3, the rib 13 of tongue 12 is replaced by two grooves 15 in a tongue 12′ in which protuberances 14 having a corresponding shape can fall alternately in the two positions of the slider means 10.

Figure 4:
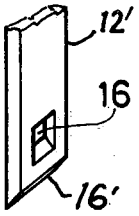

The tongue 12″ in FIG. 4 has a wedge-shaped bottom end as well as a recess 16 whose lower side is also wedge-shaped; the protuberances of the slider means 10 press against the wedge-shaped end, e.g. portion 16′, in the open circuit position and enters the recess 16 in the closed circuit position.

Figure 5:
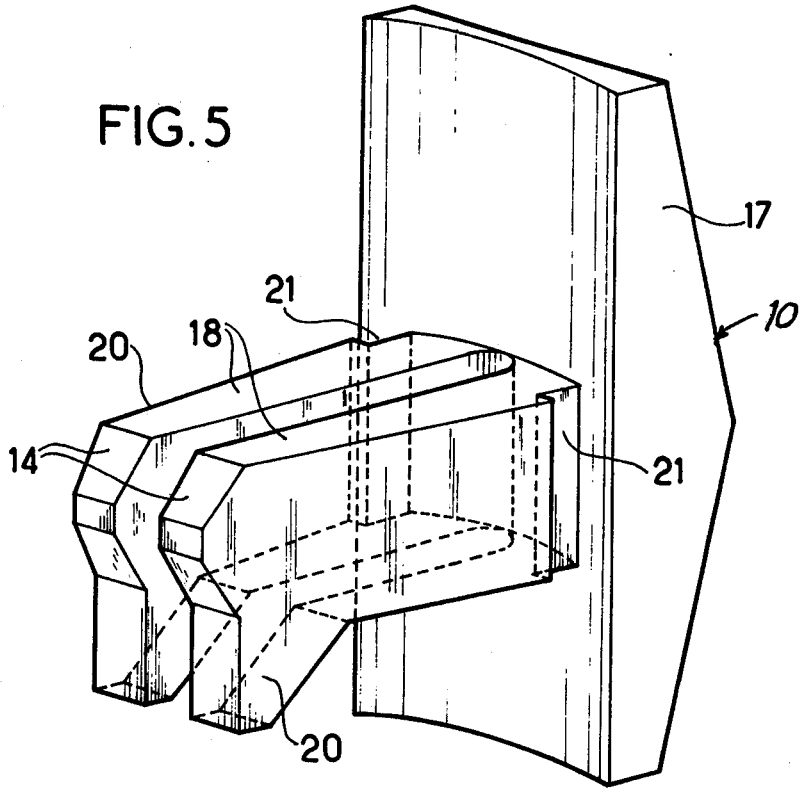
FIG. 5 is a perspective view of a slider means of FIG. 1.
Figure 6:
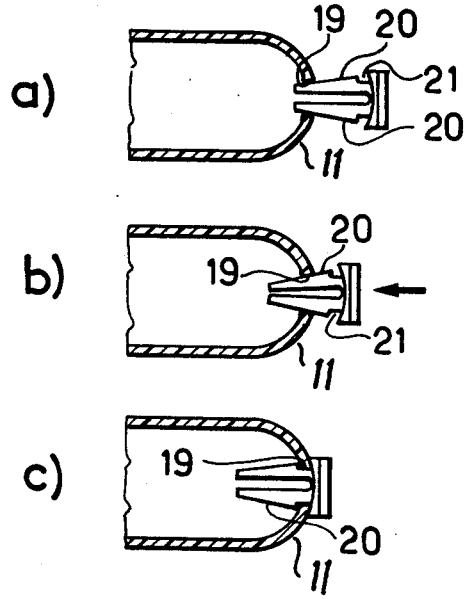
FIG. 6 shows schematically three stages (a, b, and c) in the assembly of the slider means of FIG. 5 with the lamp of FIG. 1.

The manipulative slider means 10 shown in detail in FIG. 5 consists of an operating knob or head 17 situated outside the housing 3 and two arms or prongs 18 are elastically deformable laterally and have inclined outer faces 20 and vertical grooves 21 to provide wedge means which facilitate assembly with the casing and subsequently serve to retain the slider means 10 in slidable position in slot 19 of the housing or casing 11 as shown by FIG. 6 and described hereinbelow.

The width at the inermost ends of the arms or prongs 18 is less than that of the slot 19, enabling easy positioning relative to slot 19 (diagram a). When thereafter the knob 17 is pressed inwardly, the sides of the slot 19 press against the inclined faces 20, of laterally resilient prongs 19, causing the prongs to bend toward each other (diagram b). When the grooves 21 become aligned with the edges of the slot 19 the arms or prongs resume their initial undeformed shape, thereafter preventing withdrawal or removal of the slider means (diagram c) while permitting it to slide in slot 19 of the housing.

Changes can be made to embodiments illustrated within the scope of the claims without departing from the spirit of the invention. In particular, the stationary contact blade 6 can be removed and replaced by an electric connector having any desired shape. The mobile contact 7 blade can come into contact with the base 8 of the light bulb 2 rather than with its stud 9. The circuit can be formed in such a way that it is open when the knob is in the high position, i.e., towards the reflector and closed when the knob is in the low position, i.e., towards the electric battery 1. The latter can comprise several cells or two or even only one. The housing 11 of lamp, whose construction has not been described in detail, can be made of a single plastic piece, or of a casing containing the battery and of a head comprising the wall forming a reflector, or of two half-shells. It can also have a metal sleeve with the reflector being formed by a cover. These alternatives are, however, non-limitative. Other variations within the scope of the appended claimes are possible and are contemplated. There is no intention therefore, of limitation to the exact disclosure herein presented.

What is claimed is:

1. An electric pocket lamp including an elongated molded plastic battery housing having a surrounding wall at one end thereof and an integrally molded concave plastic reflector supported by the wall and closing said one end of the housing, a light bulb centrally mounted in the reflector and having two terminals, an electric battery means positioned in the housing, the battery means having a resilient blade permanently attached to each of positive and negative poles thereof, the blades extending from the battery at the one end of the housing such that one resilient blade is biased into direct contact with one terminal of the light bulb, the wall of said housing having an elongated slot adjacent said one end, and a molded plastic slider means having a thumb-actuated knob in sliding contact with the exterior surface of said wall and a portion extending through said slot to the interior of the housing, the slider means being reciprocally movable in said slot and said interior portion of the slider means being operatively engageable with the other resilient blade for selectively opening and closing an electrical circuit between the other blade and the other terminal of the light bulb in response to reciprocal movement of the slider means in the slot, wherein the improvement comprises:

a resilient plastic appendage molded integrally with the housing and extending from the interior surface thereof in the vicinity of the slot in said wall and cooperating with the slider means to determine two positive detent positions for the slider means corresponding to the opening and closing of said electrical circuit.

2. An electric pocket lamp according to claim 1 comprising said light bulb being mounted directly in the molded plastic reflector without any other metal part, and wherein said electric circuit is closed by said other resilient blade making direct contact with the other terminal of the light bulb.

3. An electric pocket lamp according to claim 1 wherein the one terminal of the light bulb comprises a threaded metal shell and the other terminal comprises a central base terminal separated from the shell by insulating material, the one resilient blade being biased into direct contact with the shell, and the other resilient blade being biased into direct contact with the central base terminal when the slider means is in said second position.

4. An electric pocket lamp according to claim 3 wherein the slider means is closer to the one end of the housing in the second position than in the first position, and said interior portion of the slider means engages said other resilient blade to urge the other blade out of contact with the central base terminal when the slider means is in said first position.

5. An electric pocket lamp according to claim 1 wherein said slot is in a portion of the wall of the housing that extends substantially parallel to the longitudinal axis of the housing.

6. An electric pocket lamp according to claim 5 wherein the resilient plastic appendage comprises a tongue extending from the interior surface of the integrally molded reflector to a position opposite to said slot, wherein the interior portion of the slider comprises a protuberance extending into engagement with said tongue, and wherein the resilient appendage comprises position-fixing means on the surface of said tongue opposite said slot, said protuberance being engageable with said position-fixing means.

7. An electric pocket lamp according to claim 6 wherein said position-fixing means comprises a transverse rib having a triangular cross section.

8. An electric pocket lamp according to claim 6 wherein said position-fixing means comprises a recess in the surface of said tongue facing said slot, said recess having a wedge-shaped edge.

9. An electric pocket lamp according to claim 6 wherein said position-fixing means comprises two spaced grooves in said tongue, the shape of said grooves being complementary to the shape of said protuberance.

* * * * *